United States Patent [19]

Nomura

[11] 4,276,628

[45] Jun. 30, 1981

[54] ELECTRONIC TIMEPIECE

[75] Inventor: Yasushi Nomura, Tokorozawa, Japan

[73] Assignee: Citizen Watch Company Limited, Tokyo, Japan

[21] Appl. No.: 927,774

[22] Filed: Jul. 25, 1978

[30] Foreign Application Priority Data

Jul. 26, 1977 [JP] Japan ..... 52-89669

[51] Int. Cl.[3] ..... G04C 19/00; G04B 19/24

[52] U.S. Cl. ..... 368/85; 368/28

[58] Field of Search ..... 58/85.5, 4 A, 58, 23 D; 318/696; 368/85, 28

[56] References Cited

U.S. PATENT DOCUMENTS

| | | | |
|---|---|---|---|
| 3,716,983 | 2/1973 | Tanaka et al. | 58/58 |
| 4,129,981 | 12/1978 | Nomura et al. | 58/23 D |
| 4,175,372 | 11/1979 | Tamaru et al. | 368/85 |

*Primary Examiner*—Stanley J. Witkowski
*Assistant Examiner*—John B. Conklin
*Attorney, Agent, or Firm*—Sherman & Shalloway

[57] ABSTRACT

An electronic timepiece of the type of a so-called analog hand display is disclosed which displays the time by means of hands and is capable of changing the calendar display of a calendar mechanism within very short period of time by means of a reversible motor. Additionally the electronic timepiece is automatically corrected at the end of every month.

9 Claims, 14 Drawing Figures

ELECTRONIC TIMEPIECE

BACKGROUND OF THE INVENTION

1. Field of the Invention

The present invention is related to an electronic timepiece, particularly, to provide an electronic timepiece of the type of a so-called analog hand display, which displays the time by means of hands and which is capable of changing the calendar display of a calendar mechanism within very short period of time by means of a reversible motor.

2. Description of the Prior Art

Conventional electronic timepieces having an embedded calendar mechanism required several hours for changing the calendar. Therefore, during these several hours for changing the calendar, the display of the calendar was often quite invisible or was imperfectly visible depriving the calendar mechanism of the intended function. Although the calendar mechanisms were usually designed to change the display around twleve o'-clock midnight, it still could become a problem in nowadays when many people do not go to bed until after midnight.

To remove such an inconvenience, there was proposed a mechanism to quickly change the calendar by accumulating the energy transmitted by gears in a spring. This system, however, exerted excessive load on the motor dissipating increased amount of electric power and requiring complicated mechanism for accumulating the energy transmitted through gears.

Further, the conventional timepieces which do not require the resetting of the calendar at the end of the month tended to become complicated in mechanical setups, causing the movement of the timepiece to be thick, and making it difficult to manufacture the timepieces in practical sizes.

SUMMARY OF THE INVENTION

The principal object of the present invention is to provide a useful electronic timepiece which is free of the drawbacks inherent in the conventional calendar-equipped timepieces. To achieve the object, the present invention provides an electronic timepiece having a mechanism for changing the calendar within short period of time based on the fast feeding in the forward and reverse directions attained by the employment of a reversible motor.

Owing to the above-mentioned construction, the electronic timepiece provided by the present invention enables the calendar to be changed within short period of time without consuming particularly increased amount of electric power. Furthermore, the electronic timepiece provided by the present invention does not require any particularly complicated mechanism, and automatically displays the exact time after the calendar has been changed.

Another object of the present invention is to provide an electronic timepiece which does not require the resetting of the calendar at the end of the month, said electronic timepiece having a mechanism for changing the calendar within short period of time based on the fast feeding in the forward and reverse directions attained by the employment of the reversible motor.

DETAILED DESCRIPTION OF THE PREFERRED EMBODIMENTS

Figure 1:
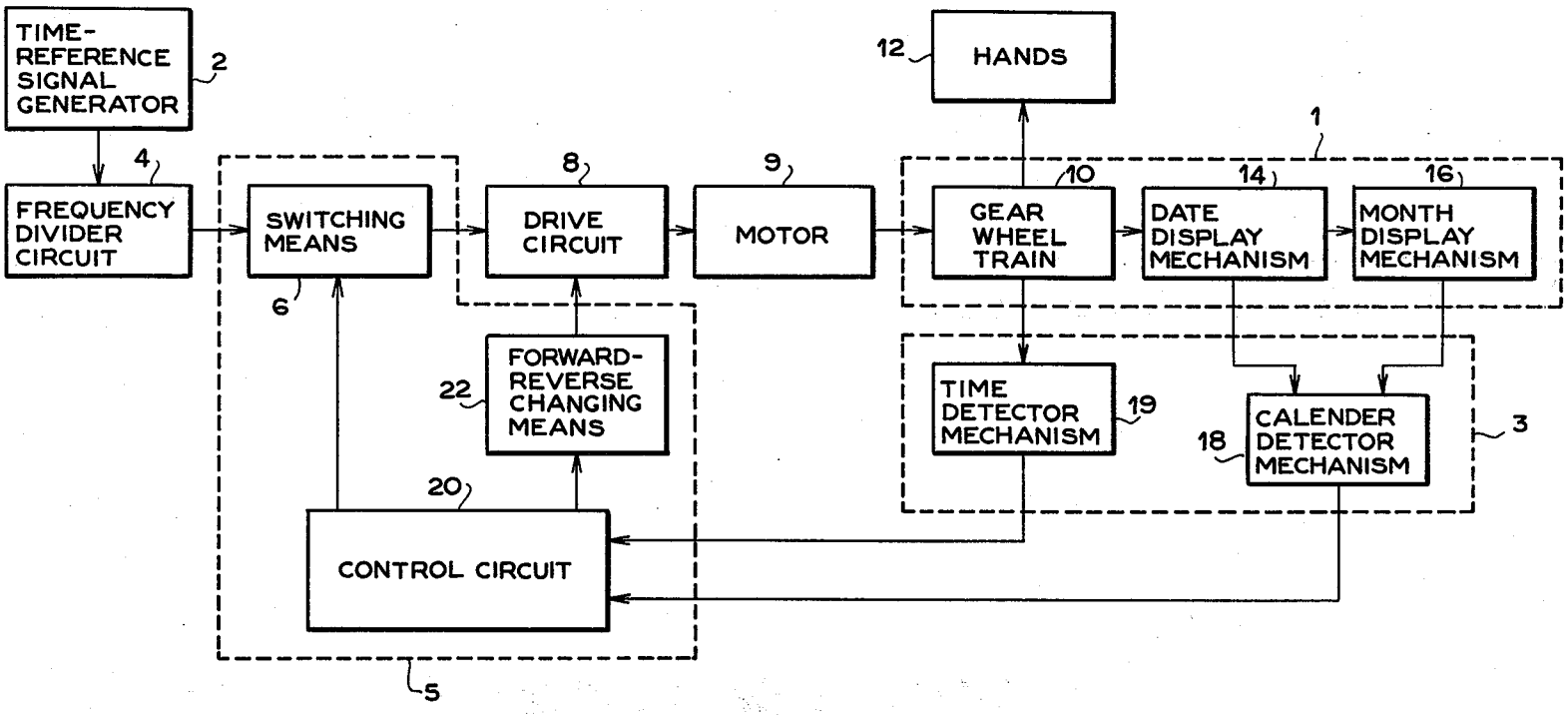
FIG. 1 is a block diagram showing an electronic timepiece according to an embodiment of the present invention.

An embodiment of the present invention is illustrated below with reference to the accompanying drawings. FIG. 1 is a block diagram showing an electronic timepiece according to an embodiment of the present invention, in which reference numeral 2 represents a time-reference signal generator consisting of, for example, a quartz oscillator for producing time-reference signals. The time-reference signals produced by the time-reference signal generator 2 are divided for their frequency by a frequency divider circuit 4 to produce time-unit signals and fast-feed signals. The time-unit signals are fed to a drive circuit 8 via a control mechanism 5 consisting of a switching means 6, a control circuit 20 and a forward-reverse changing means 22. Upon receipt of a drive signal, the drive circuit 8 causes the motor 9 to run in the forward or reverse direction. The turn of the motor 9 is transmitted to a mechanical time-keeping mechanism 1 consisting of a gear train 10, a date display mechanism 14 and a month display mechanism 16, thereby to keep the time. While the fast-feed signals may be generated by the control mechanism 5.

According to the electronic timepiece of the present invention used under ordinary condition, the drive circuit 8 receiving the time-unit signals of 1 Hz from the frequency-divider circuit 4 produces a forward pulse to turn the motor 9 in the forward direction. The rotative force of the motor 9 is then transmitted to the gear train 10 thereby to actuate hands 12 consisting of an hour hand, a minute hand and a second hand. While the motor 9 is running in the forward direction, the rotational force from the gear train 10 is not transmitted to the date display mechanism 14. When a predetermined time is displayed by the hands 12 due to the turn of the motor 9 in the forward direction, a time detector mechanism 19 detects the time depending upon the position of the gear train 10 and produces a detection signal which causes the control circuit 20 to work. The control circuit 20 so controls the switching means 6 that a fast-feed signal from the frequency divider circuit 4 is fed to the drive circuit 8, and further so controls the forward-reverse changing means 22 that the motor 9 is quickly turned in the reverse direction by the fast-feed signals fed to the drive circuit 8. As the motor 9 turns in the reverse direction, the gear train 10 is caused to turn in the direction opposite to that of the forward direction, eventually causing the hands 12 to turn in the reverse direction. In this case, the rotational force in the reverse direction is allowed to be transmitted to the date display mechanism 14. Therefore, the rotational force of the gear train 10 is transmitted to the date display mechanism 14. In this case, since the gear train 10 is running fast, the date is changed within very brief period of time. After the control circuit 20 is started to work automatically and the gear train 10 is turned by an amount necessary for changing the date, the forward-reverse changing means 22 is so controlled that the drive circuit 8 will produce fast-feed signals in the forward direction to quickly turn the motor 9 in the forward direction in order that the gear train 10 is turned fast in the forward direction. The control circuit 20 calculates the duration of time required for changing the date and the duration of time in which the fast feeding in the reverse direction took place, and performs the fast feeding in the forward direction until the delay in time is eliminated. The control circuit 20 thereafter controls the switching means 6 such that the time signals of 1 Hz are fed to the drive circuit 8 to move the hands 12 at an ordinary speed.

The embodiment mentioned in the foregoing is further equipped with a mechanism which automatically resets the calendar at the end of the month. Therefore, when the 31st day is displayed at the end of the "small month" (consisting of 30 days, i.e., smaller by one day than 31 days), the 31st day is detected by a calendar detector mechanism 18, whereby the control circuit 20 so controls that the date is changed once more by the same date-feeding mechanism as mentioned above.

Figure 2:
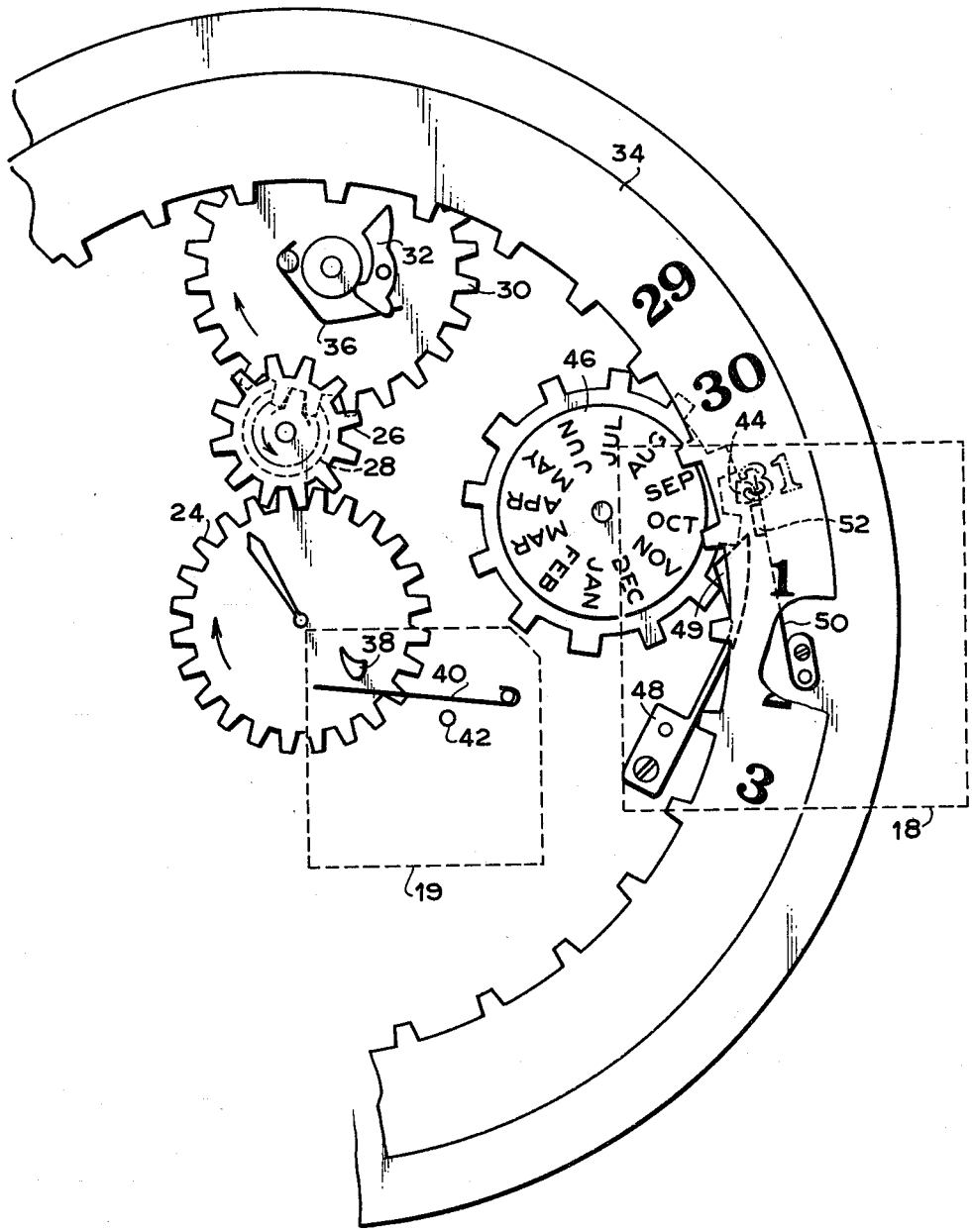
FIG. 2 is a plan view showing part of the construction of the electronic timepiece of FIG. 1.

FIG. 2 is a plan view of the electronic timepiece of FIG. 1. A date dial 34 is driven by the amount of one tooth when an hour wheel 24 on which is mounted an hour hand is turned in a direction opposite to the ordinarily turning direction by the amount of about three and a half hours by means of a date wheel finger 32 via a date transmission wheel 26, a date wheel pinion 28 and a date wheel 30.

Under the ordinary condition in which the hands are moved normally, even when the date wheel finger 32 is engaged with the date dial 34, the force is allowed to escape by means of a spring 36 so that the date dial 34 is not turned. A pin 38 is attached to the hour wheel 24. As the hour hand comes to the position of twelve o'clock, the pin 38 pushes a spring 40 which comes into contact with a separately provided contact point 42, so that the time of twelve o'clock is detected. The spring 40 comes into contact with the contact point 42 twice a day, and the night and the day are distinguished by a circuit. When the time of twelve o'clock midnight is detected, the gear train is quickly turned reversely causing the date dial 34 to be driven by one tooth within brief periods of time. After the date is changed, the gear train is quickly rotated again in the forward direction to adjust the time; the gear train is then turned at an ordinary speed. Further, according to the timepiece of the present invention, an electrically conductive pin 44 for feeding a month dial is studded on the date dial 34 in order to feed the month dial 46 when the date is changed from 31st to 1st.

The month dial 46 is provided with a monthly jumper 48. Here, the position of the tip 49 of the monthly jumper 48 is varied depending upon the "small month" (consisting of 30 days) and "large month" (consisting of 31 days) owing to the change in distance between the teeth of the month dial 46.

A switch spring 50 is provided at such a position as to come into contact with the pin 44 when the date dial 34 comes to a position to display the 31st day. However, when the month dial 46 is displaying a "large month", the tip 49 of the monthly jumper 48 outwardly pushes an insulated portion 52 of the switch spring 50, so that the switch spring 50 does not come into contact with the pin 44. However, when the month dial 46 is indicating a "small month", the tip 49 of the monthly jumper 48 does not push the insulated portion 52. The switch spring 50 therefore comes into contact with the pin 44, and the 31st day which should not be included in the small month is detected. As the 31st day which should not be included in the small month is detected, the gear train is rotated fast in the reverse directly thereby to change the date once more.

Figure 3:
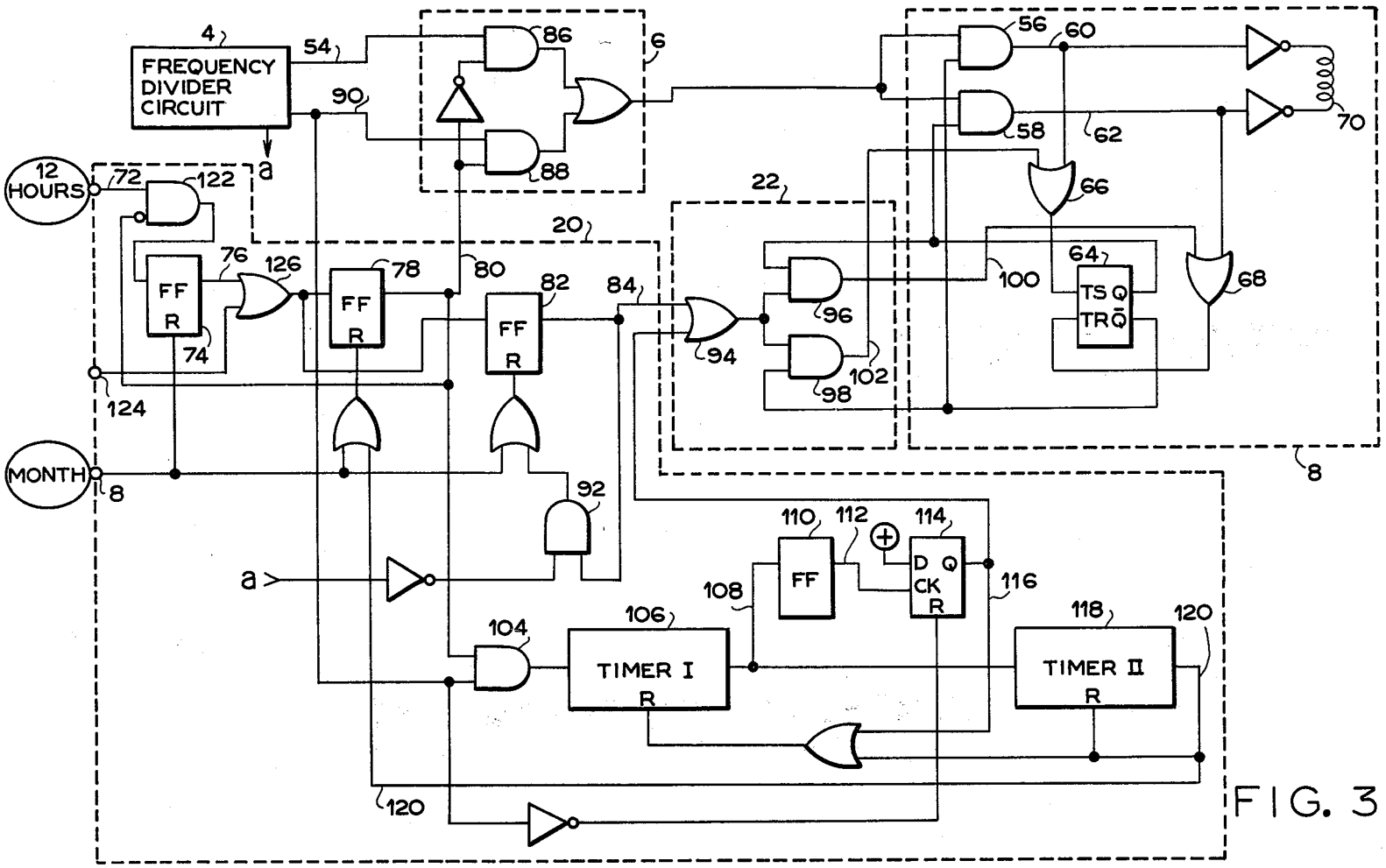
FIG. 3 is a circuit diagram showing in detail part of the block diagram of FIG. 1.

FIG. 3 is a block diagram showing part of the circuit of the timepiece of the present invention, giving importance to the control circuit 20.

Under the ordinary condition, the frequency divider circuit 4 feeds time pulse signals of 1 Hz to the drive circuit 8 via a lead wire 54 and the switching means 6.

Referring to the drive circuit 8, a trigger setting resetting flip-flop 64 is controlled by the time pulse signals produced on the output lines 60 and 62 of AND gates 56 and 58. As the time pulse signal produced on the output line 60 is fed to a TS input terminal of the flip-flop 64 via an OR gate 66, the output Q of the flip-flop 64 acquires a high level "H" just when a pulse signal breaks from the high level "H" to the low level "L"; the AND gate 58 opens and the output $\overline{Q}$ acquires the low level "L", causing the AND gate 56 to be closed. Therefore, a pulse following the time pulse signal fed from the frequency divider circuit 4 passes through the AND gate 58 and is fed on the output line 62.

The signal is then fed to the TR input terminal of the flip-flop 64 through the OR gate 68, whereby the output Q acquires the "L" level when the pulse signal is broken, and the output $\overline{Q}$ acquires the "H" level. The AND gate 56 is then opened, and the AND gate 58 is closed.

At the next moment, a pulse signal is produced on the output line 60. In this way, pulses are alternately produced on the output line 60 and the output line 62, whereby an electric current which flows alternatingly in the opposite directions is fed to a coil 70 of the motor; the polarity of the motor is changed so that the rotor of the motor is turned.

As the spring 40 shown in FIG. 2 comes into contact with the contact point 42 and the time of twelve o'clock is detected, the level of a line 72 of the control circuit 20 changes fron the "L" level into the "H" level, and the level of the output line 76 of a flip-flop 74 changes from the "L" level to the "H" level. As the spring 40 comes into contact with the contact point 42 once again, the level of the output line 76 changes from the "H" level to the "L" level, and the levels of output lines 80 and 84 of flip-flops 78 and 82 also change from "L" level into "H" level. Flip-flops 74, 78 and 82 are reset by a signal fed from an external unit to a control terminal 83 of the control circuit 20, whereby the circuit is so adjusted that the output line 76 of the flip-flop 74 acquires the "H" level when the time of twelve o'clock midday is detected, and the output line 76 acquires the "L" level when the time of twelve o'clock midnight is detected.

As the output line 80 acquires the "H" level, an AND gate 86 of the switching means 6 is closed, an AND gate 88 is opened, and fast-feed pulse signals fed from the frequency divider circuit 4 via a line 90 are fed to the drive circuit 8 via the AND gate 88 and an OR gate 89.

On the other hand, as the output line 84 acquires the "H" level, an AND gate 92 is opened, and the flip-flop 82 is reset after a small duration of time has elapsed by a signal a produced by the frequency divider circuit 4. A thin pulse signal is therefore produced on the output line 84; this signal is fed to the forward-reverse changing means 22, passed through an OR gate 94, passed through AND gate 96 or 98 whichever is open, and fed into output line 100 or 102.

The AND gate 96 is opened when the output Q of the flip-flop 64 of the drive circuit 8 is of the "H" level, and the AND gate 98 is opened when the output $\overline{Q}$ of the flip-flop 64 is of the "H" level. However, a signal which is happened to be produced on the output line 100 is fed to the TR input terminal of the flip-flop 64 via the OR gate 68, causing the output Q to acquire the "L" level and the output $\overline{Q}$ to acquire the "H" level. As a signal is produced on an output line 102, said signal is fed to the TS input terminal of the flip-flop 64 via the OR gate 66, whereby the output Q acquires the "H" level and the output $\overline{Q}$ acquires the "L" level. That is, the output state of the flip-flop 64 is reversed. Under this condition, the fast-feed pulse signals switched by the switching means 6 are transmitted from the frequency divider circuit 4 through the line 90. However, since the output state of the flip-flop 64 is reversed and, eventually, since the open-close state of the AND gates 56 and 58 is reversed, the pulse signals are successively produced on the sides of the output lines 60 and 62 on which were produced the final pulses under ordinary condition. The motor is then caused to run in the reverse direction. Thereafter, the pulses are alternatively produced on the output lines 60 and 62 maintaining the reversed state thereby to effect fast feeding in the reverse direction.

As the output line 80 acquires the "H" level, on the other hand, the AND gate 104 is opened, and fast-feed signals are fed from the line 90 to a timer 106.

The timer 106 is so constructed as to calculate the time needed for driving the date dial 34 of FIG. 2 by one tooth by the reversed turn of the gear train. After the date dial 34 is moved by one tooth to change the date, the level of the output line 108 of the timer 106 is changed from the "L" level to the "H" level. As the level of the output line 108 is changed from the "L" level into the "H" level, the level of the output line 112 of a flip-flop 110 is changed from the "L" level into the "H" level, whereby a thin pulse signal is produced on an output line 116 of a flip-flop 114. This signal is fed to the forward-reverse changing means 22 to control the forward or reverse direction of the drive circuit 8 in the same way as when a pulse signal was produced on the output line 84; the motor which had been turned fast in the reverse direction is now caused to run fast in the forward direction.

On the other hand, as a thin pulse signal is produced on the output line 116, the timer 106 is reset to measure again the duration of time. After a time equal to the duration of time in which the motor was reversely turned is elapsed, the level of the output line 108 of the timer 106 is again changed from the "L" level to the "H" level. In this case, however, since the level of the output line 112 of the flip-flop 110 is acquiring the "H" level, the level of the output line 112 is simply caused to be changed from the "H" level to the "L" level, and no thin pulse signals are produced by the flip-flop 114. A timer 118, therefore, starts the counting operation based on the fast-feed signals fed through the line 90 and continues the counting operation until the time delay spent by the fast feeding in the reverse direction and the fast feeding in the forward direction is eliminated. The level of the output line 120 is then changed from the "L" level to the "H" level, the flip-flop 78 is reset, the level of the output line 80 is returned from the "H" level to the "L" level, the AND gate 86 of the switching means 6 is opened, and the AND gate 88 is closed, whereby the fast feeding in the forward direction is stopped and normal operation is resumed.

Further, the level of the output line 120 which has acquired the "H" level causes the timer 106 and the timer 118 to be reset. Moreover, at the moment when the fast feeding in the reverse direction is converted again into the fast feeding in the forward direction, the spring 40 comes into contact with the contact point 42 shown in FIG. 2 whereby a detection signal of the time of twelve o'clock is introduced. When the line 80 is acquiring the "H" level, however, the gate 122 remains closed; the operation of the timepiece is not affected.

The detection signal of the 31st day which should not be included in the "small month" detected by a detecting mechanism is fed from an input terminal 124 of the control circuit 20 and passes through the OR gate 126, causing the levels of the flip-flops 78 and 82 to be changed from the "L"" level to the "H" level, whereby the control circuit 20 causes a change in the date in the same manner as when a signal is fed from the time detector mechanism 19. That is, the calendar is changed by one more day of the month.

Below is illustrated the calendar changing operation mode with reference to the time and calendar display dial shown in FIG. 4. In this embodiment, the day of the week and the date of the month are changed by the fast feeding of the motor 9 in the reverse direction, and the time and the hands are adjusted by the fast feeding of the motor 9 in the forward direction.

Figure 4:
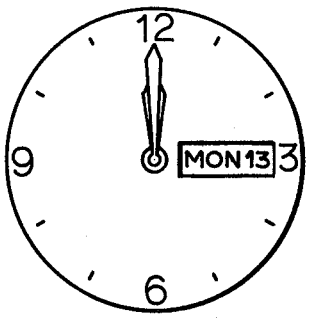
FIGS. 4 (*a*) to (*e*) are diagrams for illustrating the operation modes of the time and calendar display portion of FIG. 1.
Figure 4:
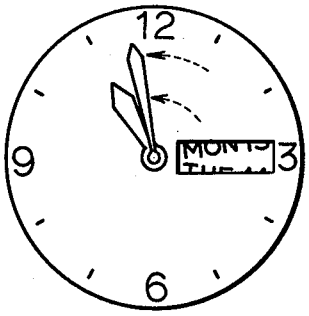
Figure 4:
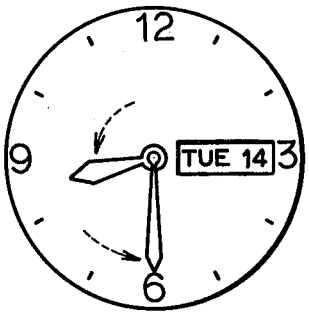
Figure 4:
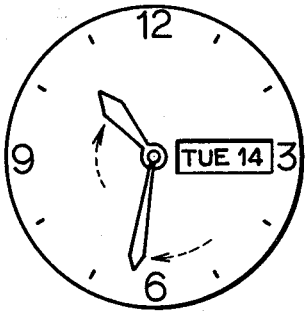
Figure 4:
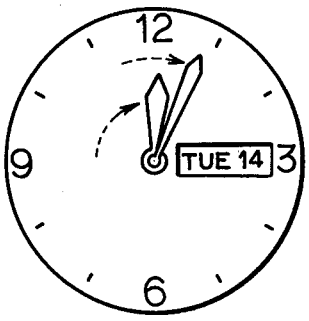

First, referring to the diagram (a) of FIG. 4, the hour hand and the minute hand are located at the position of twelve o'clock, and the calendar display portion displays the 13th day and Monday. With the hour hand at the position of twelve o'clock, the hands are quickly fed in the reverse direction.

The diagram (b) of FIG. 4 shows when the hour hand and the minute hand are being quickly fed in the reverse direction; the calendar starts to change.

The diagram (c) of FIG. 4 shows that the hands are further quickly fed in the reverse direction up to eight thirty. At this position, the calendar is changed by one day to exactly indicate the fourteenth, Tuesday. From this position, the hands starts to be quickly fed in the forward direction.

The diagram (d) of FIG. 4 shows when the hands are being quickly fed in the forward direction to adjust the time.

Referring to the diagram (e) of FIG. 4, the time has been adjusted and the hands are indicating several minutes past twelve. At this position, the fast feeding of the hands is finished, and the hands are turned at a normal speed. A duration of several minutes will be required before the operation of diagram (a) to diagram (e) of FIG. 4 is completed.

Further, the timepiece of the present invention employs a mechanism which does not require the resetting of the calendar at the end of the month; i.e., at the end of the "small month", the mode shown by the diagrams (a) to (e) of FIG. 4 is repeated by the calendar detector mechanism to automatically indicate the new month.

Figure 5:
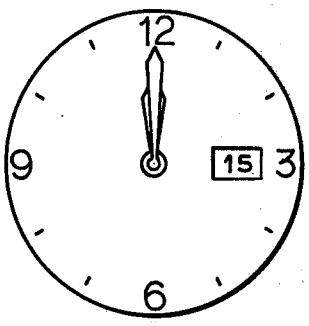
FIGS. 5 (*a*) to (*e*) are diagrams for illustrating the operation modes of the time and calendar display portion according to another embodiment of the present invention.
Figure 5:
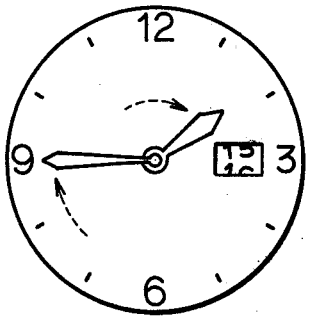
Figure 5:
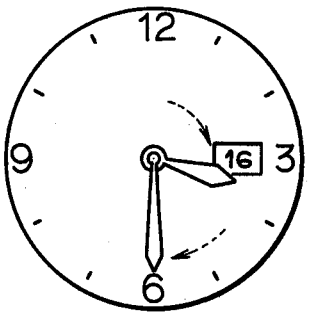
Figure 5:
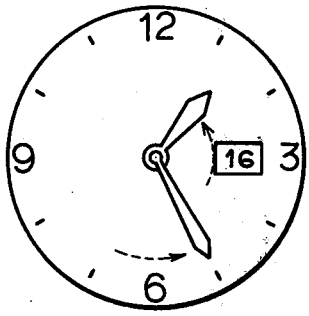
Figure 5:
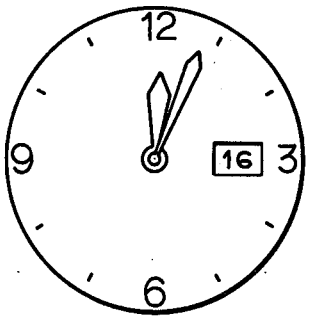

FIG. 5 shows another embodiment according to the present invention. In this embodiment, the calendar is changed by the fast feeding of the motor 9 in the forward direction, and the time is adjusted by the fast feeding of the motor 9 in the reverse direction.

Referring now to the diagram (a) of FIG. 5, the hour hand and the minute hand are located at the position of twelve o'clock, and the calendar display portion is indicating the fifteenth. From this mode, the hands are quickly fed in the forward direction.

The diagram (b) of FIG. 5 shows when the hour hand and the minute hand are being quickly fed in the forward direction. The calendar starts to be changed, and part of the sixteenth day is seen.

Next, referring to the diagram (c) of FIG. 5, the hands are further quickly fed in the forward direction up to the position of a quarter past three. At this position, the calendar is changed by one day to exactly indicate the sixteenth day. From this position, the hands are quickly fed in the reverse direction to adjust the time.

Next, the diagram (d) of FIG. 5 shows when the hands are being quickly fed in the reverse direction to adjust the time.

Referring to the diagram (e) of FIG. 5, the time has been adjusted, and the hands ate indicating several minutes past twelve o'clock. At this position, the fast feeding of the hands in the reverse direction is finished, and the hands are moved at a normal speed.

Figure 6:
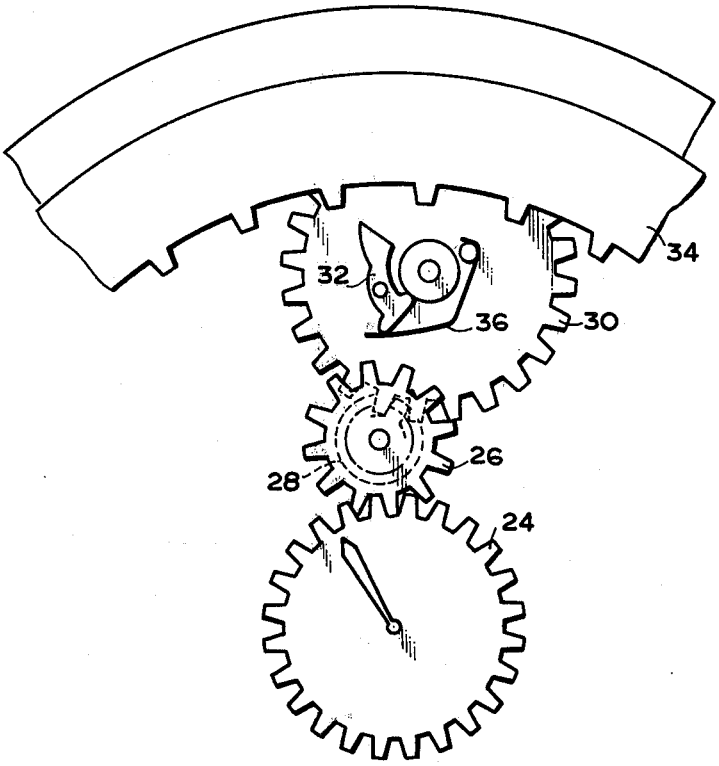
FIG. 6 is a plan view showing part of the construction of the electronic timepiece with reference to FIGS. 5 (*a*) to (*e*).

FIG. 6 is a plan view showing an important portion of the electronic timepiece of the present invention which performs the operation of diagram (a) to diagram (e) of FIG. 5. The difference from the construction shown in FIG. 2 is that a date wheel finger 32′ provided on a date wheel 30 and a spring 36′ are mounted in the opposite manner as the date wheel finger 32 and the spring 36 shown in FIG. 2. Under the ordinarily operating condition, if the hands come to the position of a predetermined time, the date wheel finger 32 causes the date dial to be turned. When the hands are turning in the direction opposite to the normal hand-moving direction, the date dial 34 is not turned even if the date wheel finger 32′ is engaged with the date dial 34, since the force is allowed to escape by means of a spring 36′. In this case, also, the calender can be quickly fed within brief period of time as illustrated with reference to FIG. 5.

As illustrated in the foregoing, with the electronic timepiece according to the present invention, the date can be changed within very brief periods of time.

For example, if pulse signals of 64 Hz are used as fast-feed signals of FIG. 3, the hands can be quickly fed in the reverse direction and the date can be changed in a matter of 2 to 3 minutes, and the hour hand and the minute hand can be adjusted to the exact time in 2 to 3 minutes. Though the hour hand and the minute hand may not indicate the exact time during the above period, the users will become accustomed to the habit that the date is changed once a day at a predetermined time and will also become able to guess the time by observing the state of fast feeding in the reverse direction or in the forward direction. Moreover, with the timepiece which can turn the hands in both the forward and reverse direction, the operation in the forward and reverse directions performed automatically once a day enables the additional functions of the timepiece to be fully exhibited, providing unique features that were not found with the conventional analog timepieces.

For example, the timepiece of the present invention makes a distinguished difference over the prior arts where the reversible motor was used merely for the purpose of alarming the life of the battery by moving the hands in the forward or reverse directions while keeping the exact time. Use of the reversible motor for alarming the life of the battery at such a scarce frequency as once for every year or every year as done by the conventional arts, rather leaves asleep the function of reversible operation.

According to the present invention which performs the abovesaid function as well as the function contemplated by the invention, the functions of the reversible motor can be sufficiently exhibited. Here, it should be noted that the embodiment mentioned in the foregoing with reference to the accompanying drawings is only to illustrate the present invention while it could be contemplated to drive not only the date dial but also to drive the day dial. Furthermore, the time detector mechanism may be composed of studding a pin on the day wheel to take out a signal once a day. In any way, the calendar changing mechanism according to the present invention makes it possible to quickly change the calendar and is a novel system of this kind which was not contrived so far. In addition, with the electronic timepiece of the present invention, it is easy to incorporate a mechanism which eliminates the need of resetting the calendar at the end of the month.

What is claimed is:

1. An electronic timepiece comprising:

(a) a time reference source generating a time reference signal;

(b) a frequency divider synthesizing a timing signal and a fast feed signal in accordance with said time reference signal;

(c) a driving circuit synthesizing a driving signal in response to said timing signal;

(d) a reversible motor driven by said driving signal;

(e) a mechanical time keeping mechanism for keeping time in response to forward drive of said reversible motor;

(f) time display means comprising hands for displaying in analog mode the time kept by said mechanical time keeping mechanism;

(g) date display means driven by reverse drive of said reversible motor;

(h) a time detection mechanism detecting a specified time of day in the time kept by said mechanical time keeping mechanism to generate a detection signal;

(i) control means receiving said detection signal, comprising:

(1) means for transmitting said timing signal to said reversible motor for driving said mechanical time keeping mechanism to keep time;

(2) means for transmitting said fast feed signal to said reversible motor and for controlling said driving circuit to drive said motor in a reverse direction, for a first period of time, for advancing said date display means in response to said detection signal; and (3) means for transmitting said fast feed signal to said reversible motor and for controlling said driving circuit to drive said motor in a forward direction, for a second period of time, subsequent to advancing of said date display means;

(j) said reversible motor rotating said hands in a clockwise direction during forward drive thereof, and in a counterclockwise direction during reverse drive thereof.

2. The electronic timepiece recited in claim 1 wherein said control means further comprises timing means for causing said second period of time to compensate for said first period of time thereby causing said hands to display accurately the time after conclusion of said second period of time.

3. The electronic timepiece recited in claim 1 wherein said time detection means further comprises a pin on an hour wheel attached to an hour hand of said hands, a spring operated by said pin and a contact detecting operation of said spring by said pin for transmitting said detection signal to said control means.

4. The electronic timepiece recited in claim 1 wherein said date display means further comprises month display means, said timepiece further comprising calendar detection means for detecting a calendar date kept by said date display means and said month display means, said control means further comprising means responsive to said calendar detection means for automatically correcting said date display means at the end of a month.

5. An electronic timepiece comprising:

(a) a time reference signal source (2) generating a time reference signal;

(b) a frequency divider (4) synthesizing a time unit signal and a fast feed signal in response to said time reference signal;

(c) a driving circuit (8) synthesizing a driving signal in response to said time unit signal;

(d) a reversible motor (9) driven by said driving signal;

(e) a wheel train (10) driven by said reversible motor;

(f) hands (12) driven by the output of said wheel train for displaying the time;

(g) a date display means (14) driven by the output of said wheel train for displaying the date;

(h) a month display means (16) driven by the output of said date display means for displaying the month;

(i) a calendar detection means (18) detecting the date kept by the position of said date display means and the month kept by the position of said month display means;

(j) a time detection means (19) detecting a specified time of day kept by said wheel train;

(k) control means (5) receiving said detection signal from said time detection means, and selectively transmitting said time unit signal and said fast feed signal to said driving circuit in response to said detecting signal, for causing said reversible motor to be driven in the forward and reverse directions and for altering the date shown on said date display means without altering the time displayed by said hands;

(1) said time detection means having:

(i) an hour wheel (24) on which said hands are provided, (ii) a date transmission wheel (26) rotatably engaging said hour wheel, (iii) a date wheel pinion (28) provided at said date transmission wheel, (iv) a date wheel (30) rotatably engaging said date wheel pinion, (v) a spring (36) provided on said date wheel and operated by said date wheel, and (vi) a date wheel finger (32) detecting the operation of said spring by said date wheel for transmitting said detection signal to said control means; and (m) a date dial (34) constituting said date display means and fed by said date wheel finger only when said hour wheel is rotated in a particular direction.

6. The electronic timepiece recited in claim 5 wherein said particular direction is the reverse of its normal timekeeping direction.

7. An electronic timepiece comprising:

(a) a time reference signal source (2) generating a time reference signal;

(b) a frequency divider (4) synthesizing a time unit signal and a fast feed signal in response to said time reference signal; (c) a driving circuit (8) synthesizing a driving signal in response to said time unit signal;

(d) a reversible motor (9) driven by said driving signal;

(e) a wheel train (10) driven by said reversible motor;

(f) hands (12) driven by the output of said wheel train for displaying the time;

(g) a date display means (14) driven by the output of said wheel train for displaying the date;

(h) a month display means (16) driven by the output of said date display means for displaying the month;

(i) a calendar detection means (18) detecting the date kept by the position of said date display means and the month kept by the position of said month display means;

(j) a time detection means (19) detecting a specified time of day kept by said wheel train;

(k) control means (5) receiving said detection signal from said time detection means, and selectively transmitting said time unit signal and said fast feed signal to said driving circuit in response to said detecting signal, for causing said reversible motor to be driven in the forward and reverse directions and for altering the date shown on said date display means without altering the time displayed by said hands;

(1) said control means having:

(i) a control circuit (20) receiving the detection signals when a given time is detected by said time detection means and said calendar detection means, (ii) a switching means (6) connected between said frequency divider and said driving circuit, and controlled by said control circuit to change over said time unit signal to transmit said fast feed signal to said driving circuit, and (iii) a forward-reverse changing means (22) receiving the output of said control circuit and transmitting fast feed rotation signals to said driving circuit so as to first rotate said motor in a first direction whereby said gear wheel train rotates in one direction with respect to its normal direction so that said hands also rotate in the one direction with respect to normal rotation thereof, after completion of fast feed for a given time the rotation force of said gear wheel train being transmitted to said date display means so that said date display means is fed by one day, then said control circuit again controlling said forward-reverse changing means so as to fast rotate said motor in a second direction, said gear wheel train and said hands being fast rotated in another direction thereby, the rotation force of said gear wheel train not being transmitted to said date display means during rotation in said another direction.

8. The electronic timepiece recited in claim 7 wherein said first direction is a reverse direction and said second direction is a forward direction, and wherein said one direction is an opposite direction and said another direction is a same direction.

9. The electronic timepiece recited in claim 7 wherein said first direction is a forward direction and said second direction is a reverse direction, and wherein said one direction is a same direction and said another direction is an opposite direction.

* * * * *